US008763436B2

(12) United States Patent
Knewtson

(10) Patent No.: US 8,763,436 B2
(45) Date of Patent: Jul. 1, 2014

(54) SERVO-CONTROLLED THREE AXIS WIRE STRAIGHTENING DEVICE

(75) Inventor: Kelly M. Knewtson, Joplin, MO (US)

(73) Assignee: L&P Property Management Company, South Gate, CA (US)

( * ) Notice: Subject to any disclaimer, the term of this patent is extended or adjusted under 35 U.S.C. 154(b) by 562 days.

(21) Appl. No.: 13/179,039

(22) Filed: Jul. 8, 2011

(65) Prior Publication Data

US 2013/0008555 A1 Jan. 10, 2013

(51) Int. Cl.
*B21D 3/02* (2006.01)
*B21F 1/02* (2006.01)

(52) U.S. Cl.
CPC .. *B21F 1/02* (2013.01); *B21F 1/023* (2013.01)
USPC ..... 72/162; 72/164; 140/147

(58) Field of Classification Search
CPC ..... B21F 1/00; B21F 1/006; B21F 1/02; B21F 1/023; B21F 7/00; B21D 3/02; B21D 3/04
USPC ..... 72/160–162, 164–166, 169, 77–79; 140/147
See application file for complete search history.

(56) References Cited

U.S. PATENT DOCUMENTS

| | | | | |
|---|---|---|---|---|
| 1,914,975 | A * | 6/1933 | Nigro | 72/164 |
| 2,517,309 | A | 8/1950 | Heller | |
| 2,720,242 | A * | 10/1955 | Siegerist | 72/162 |
| 3,893,316 | A | 7/1975 | Simich | |
| 4,219,052 | A | 8/1980 | Aronhalt | |
| 4,464,919 | A | 8/1984 | Labbe | |
| 4,612,792 | A | 9/1986 | De Bondt et al. | |
| 5,676,010 | A | 10/1997 | College et al. | |
| 6,584,823 | B2 | 7/2003 | Hresc et al. | |
| 2004/0050131 | A1 | 3/2004 | Militaru et al. | |

FOREIGN PATENT DOCUMENTS

JP 05337582 A * 12/1993

* cited by examiner

*Primary Examiner* — Debra Sullivan
(74) *Attorney, Agent, or Firm* — Wood, Herron & Evans, LLP

(57) ABSTRACT

A wire straightener comprises a wire feed path, a first set of rollers disposed in a first plane along the wire feed path, a second set of rollers disposed in a second plane along the wire feed path, the first and second planes being substantially perpendicular to one another, a first motor operable to adjust a position of at least one of the rollers of the first set of rollers when actuated, and a second motor operable to adjust a position of at least one of the rollers of the second set of rollers when actuated.

36 Claims, 11 Drawing Sheets

SERVO-CONTROLLED THREE AXIS WIRE STRAIGHTENING DEVICE

RELATED APPLICATIONS

N/A

FIELD OF THE INVENTION

This invention relates generally to wire straighteners, and more particularly to multiple axis wire straighteners for non-circular cross-section wires.

BACKGROUND OF THE INVENTION

Typically, wire is manufactured and then reeled or coiled for ease of storage, shipment, and handling. The reeled or coiled wire takes on undesired deformations including bends or kinks. In various types of manufacturing equipment that utilize wire, it is necessary to supply the equipment with wire that is precisely straight.

One conventional method of straightening wire is to use a wire straightener having two sets of rollers oriented at right angles, each set of rollers straightening the wire in its respective plane. The position of the rollers may be manually adjusted to accommodate wires of different dimensions as well as to apply a desired level and direction of straightening force to the wire.

Another conventional method of straightening wire, in the case of wire having a circular cross-section, is to use a spinning straightening device comprising a block of steel or other metal known as a "flyer" or "log" which houses several alternating adjustable dies and which spins around the axis of the wire at a very high speed. As the flyer spins around the wire, the wire is pulled or pushed through the dies in the flyer longitudinally. Two flyers may be used, spinning in opposite directions, to counteract any twisting caused by a single flyer spinning in only one direction. By adjusting the dies against the wire passing through the flyer, more or less pressure can be applied to the wire and the wire is dynamically straightened.

The effectiveness of a wire straightener for a given wire is dependent on the precise position of the rollers, such that even a slight adjustment to the rollers' position can change the resulting straightness of the wire. The conventional two plane wire straightener can be very finicky to adjust. Therefore, a wire straightener allowing the user to easily, consistently and repeatably adjust the rollers into a precise position is needed.

Coiling or other methods of storing wire can also result in helical deformation in the form of twists. The conventional wire straighteners discussed above do not directly remedy twists in the wire. Therefore, it would be advantageous for a wire straightener to also straighten twists in the wire.

The conventional spinning flyer wire straightener cannot be used on wire having a non-circular cross-section. While the conventional two plane wire straightener can be used on wire having a non-circular cross-section, as mentioned above it is finicky to adjust. Therefore, a wire straightener allowing the user to straighten wire having a non-circular cross-section, and which is easy to adjust, is needed.

SUMMARY OF THE INVENTION

Accordingly, in one aspect the invention is a wire straightener, comprising a wire feed path, a first set of rollers disposed in a first plane along the wire feed path, a second set of rollers disposed in a second plane along the wire feed path, the first and second planes being substantially perpendicular to one another, a first motor operable to adjust a position of at least one of the rollers of the first set of rollers when actuated, and a second motor operable to adjust a position of at least one of the rollers of the second set of rollers when actuated.

The straightener can further comprise a third motor operable to rotate the first and second sets of rollers about an axis defined by the wire feed path. The first and second sets of rollers can be mounted to a carriage, and the third motor can be a servo motor operatively connected to the carriage through a gear assembly to rotate the carriage about the axis defined by the wire feed path.

The first motor can be a servo motor operatively connected to a first liner actuator operatively connected to the at least one of the first set of rollers, such that adjusting a position of the first linear actuator adjusts a position of the at least one of the first set of rollers. The straightener can further comprise a first pivot plate operatively connected to the first linear actuator, and the at least one of the first set of rollers can comprise two rollers mounted to the first pivot plate, the first pivot plate configured to pivot and adjust a position of the two rollers of the first set of rollers based on movement of the first linear actuator. The first set of rollers can comprise a third roller positioned on an opposite side of the wire feed path from the two rollers, the third roller having an axis of rotation, the first pivot plate having a pivot axis, the axis of rotation of the third roller and the pivot axis of the first pivot plate being collinear.

The second motor can be a servo motor operatively connected to a second liner actuator operatively connected to the at least one of the second set of rollers, such that adjusting a position of the second linear actuator adjusts a position of the at least one of the second set of rollers. The straightener can further comprising a second pivot plate operatively connected to the second linear actuator, and the at least one of the second set of rollers can comprise two rollers mounted to the second pivot plate, the pivot plate configured to pivot and adjust a position of the two rollers of the second set of rollers based on movement of the second linear actuator. The second set of rollers can comprise a third roller positioned on an opposite side of the wire feed path from the two rollers, the third roller having an axis of rotation, the second pivot plate having a pivot axis, the axis of rotation of the third roller and the pivot axis of the second pivot plate being collinear.

The straightener can be especially adapted to straighten a wire having a non-circular cross-section. The first and second sets of rollers include grooves adapted to receive the non-circular cross-section wire and prevent the wire from twisting relative to the grooves. For a wire having a rectangular cross-section, the grooves are matingly rectangular.

In another aspect, the invention is a wire straightener comprising a wire feed path, a carriage rotatable about an axis defined by the wire feed path, a first set of rollers mounted to the carriage and disposed in a first plane along the wire feed path, a second set of rollers mounted to the carriage and disposed in a second plane along the wire feed path, the first and second planes being substantially perpendicular to one another, a first motor operable to adjust a position of at least one of the rollers of the first set of rollers when actuated, a second motor operable to adjust a position of at least one of the rollers of the second set of rollers when actuated, and a third motor operable to rotate the carriage about the axis defined by the wire feed path.

The straightener can further comprise a controller in communication with the first, second, and third motors, the controller operable to receive inputs from a user and to send outputs to the first, second, and third motors representative of the inputs.

In yet another aspect, the invention is a wire straightener comprising a wire feed path, a first set of rollers disposed in a first plane along the wire feed path, a first motor operable to adjust a position of at least one of the rollers of the first set of rollers when actuated, and a controller in communication with the first motor, the controller operable to receive an input from a user indicative of a desired position of the at least one of the first set of rollers and to send an output to the first motor representative of the input to position the at least one of the first set of rollers in the desired position.

In yet another aspect, the invention is a method of straightening a wire comprising the steps of feeding a length of wire from a supply of wire through first and second sets of rollers, straightening the length of wire in a first plane with the first set of rollers by moving a first roller of the first set of rollers relative to a second roller of the first set of rollers, straightening the length of wire in a second plane, substantially perpendicular to the first plane, with the second set of rollers by moving a first roller of the second set of rollers relative to a second roller of the second set of rollers, and untwisting the length of wire by rotating the first and second sets of rollers relative to the wire supply about an axis of the wire.

The method can further comprise the step of controlling the movement of the first roller of the first set of rollers, the movement of the first roller of the second set of rollers, and the rotation of the first and second sets of rollers with a controller configured to receive inputs from a user indicative of desired positions of the first roller of the first set of rollers, the first roller of the second set of rollers, and the first and second sets of rollers, and to send outputs to respective first, second, and third motors representative of the inputs to position the first roller of the first set of rollers, the first roller of the second set of rollers, and the first and second sets of rollers in the desired positions.

In yet another aspect, the invention is a method of straightening a wire comprising the steps of feeding a length of wire from a supply of wire through first and second sets of rollers, monitoring a curvature and twist of the length of wire, and based upon the curvature and twist of the length of wire, straightening the length of wire in a first plane with the first set of rollers by moving a first roller of the first set of rollers relative to a second roller of the first set of rollers, straightening the length of wire in a second plane, substantially perpendicular to the first plane, with the second set of rollers by moving a first roller of the second set of rollers relative to a second roller of the second set of rollers, and untwisting the length of wire by rotating the first and second sets of rollers relative to the wire supply about an axis of the wire.

The step of monitoring the curvature and twist of the length of wire can be performed visually by an operator, or performed by a sensor, for example a machine vision sensor.

One advantage of the present invention is that a wire straightener is provided that allows a user to consistently and repeatably adjust the rollers into a precise position by virtue of the rollers being adjusted by a servo motor.

Another advantage of the present invention is that a wire straightener is provided that straightens or untwists twists in the wire.

Yet another advantage of the present invention is that a wire straightener is provided that allows the user to straighten wire having a non-circular cross-section.

Yet another advantage of the present invention is that a wire straightener is provided which is fully automated.

These and other objectives and advantages of the present invention will become more readily apparent during the following Detailed Description in conjunction with the Drawings herein.

DETAILED DESCRIPTION OF THE DRAWINGS

Figure 1:
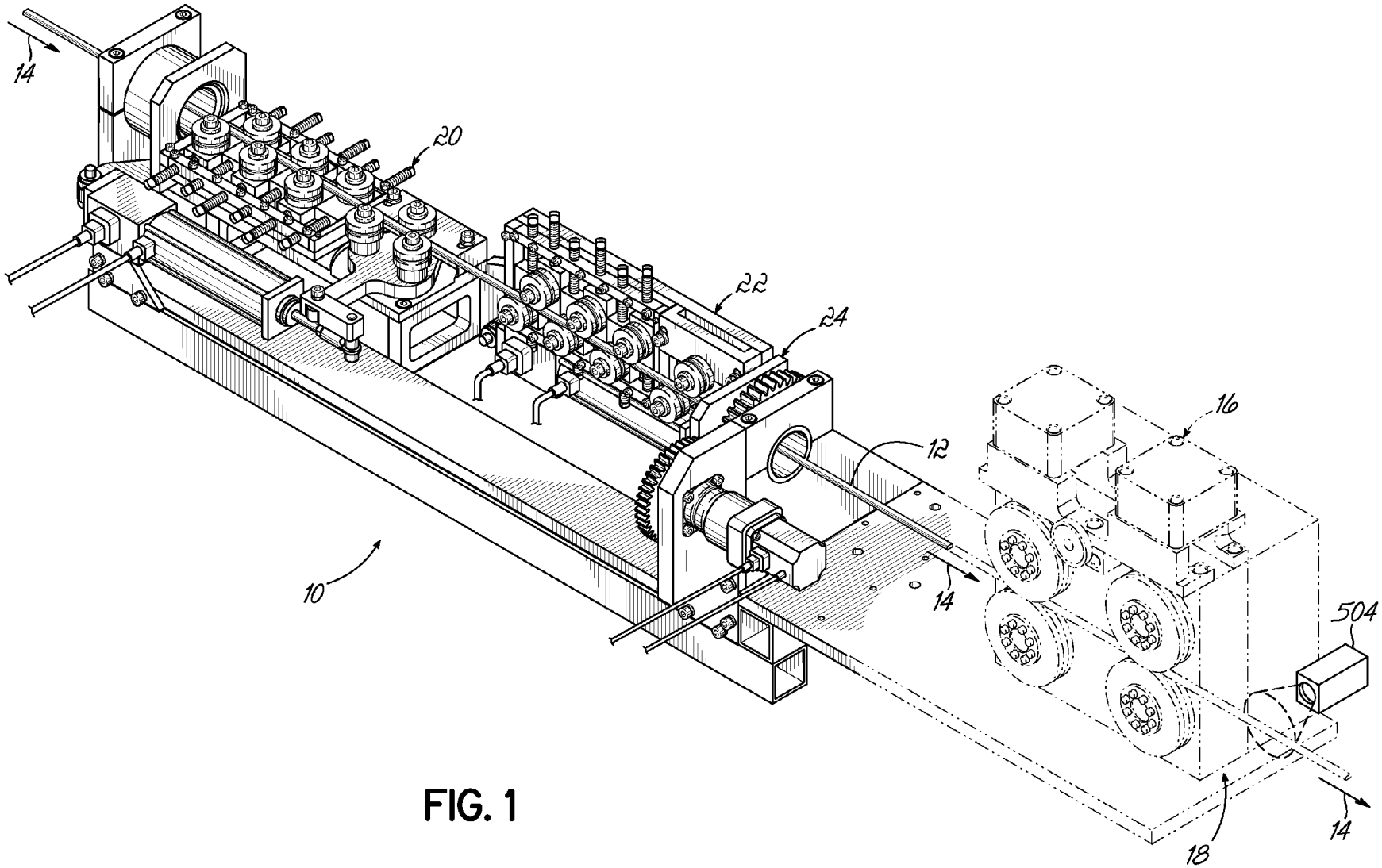
FIG. 1 a perspective view of the wire straightener of the present invention.

Referring first to FIG. 1, a wire straightener according to the principals of the present invention is illustrated at 10. The straightener 10 straightens a wire 12 that is drawn through the straightener 10 in the direction of arrow 14 from a wire supply along a wire feed path by a wire feed box 16.

The straightener 10 comprises a horizontal wire straightener 20 for straightening the wire 12 in a horizontal plane and a vertical wire straightener 22 for straightening the wire 12 in a vertical plane. The horizontal and vertical straighteners 20, 22 are mounted substantially perpendicular to one another on a carriage 24 that is rotatable about an axis defined by the wire feed path; rotation of the carriage 24 serves to untwist the wire 12. As used herein, the terms "horizontal" and "vertical" are used merely for convenience and illustrative purposes only to designate first and second straighteners 20, 22 on straightener 10; those skilled in the art will readily appreciate that rotating carriage 24 about the axis defined by the wire feed path, as will be described below, will cause the horizontal straightener 20 and vertical straightener 22 to move out of their respective initial horizontal and vertical planes.

Figure 2:
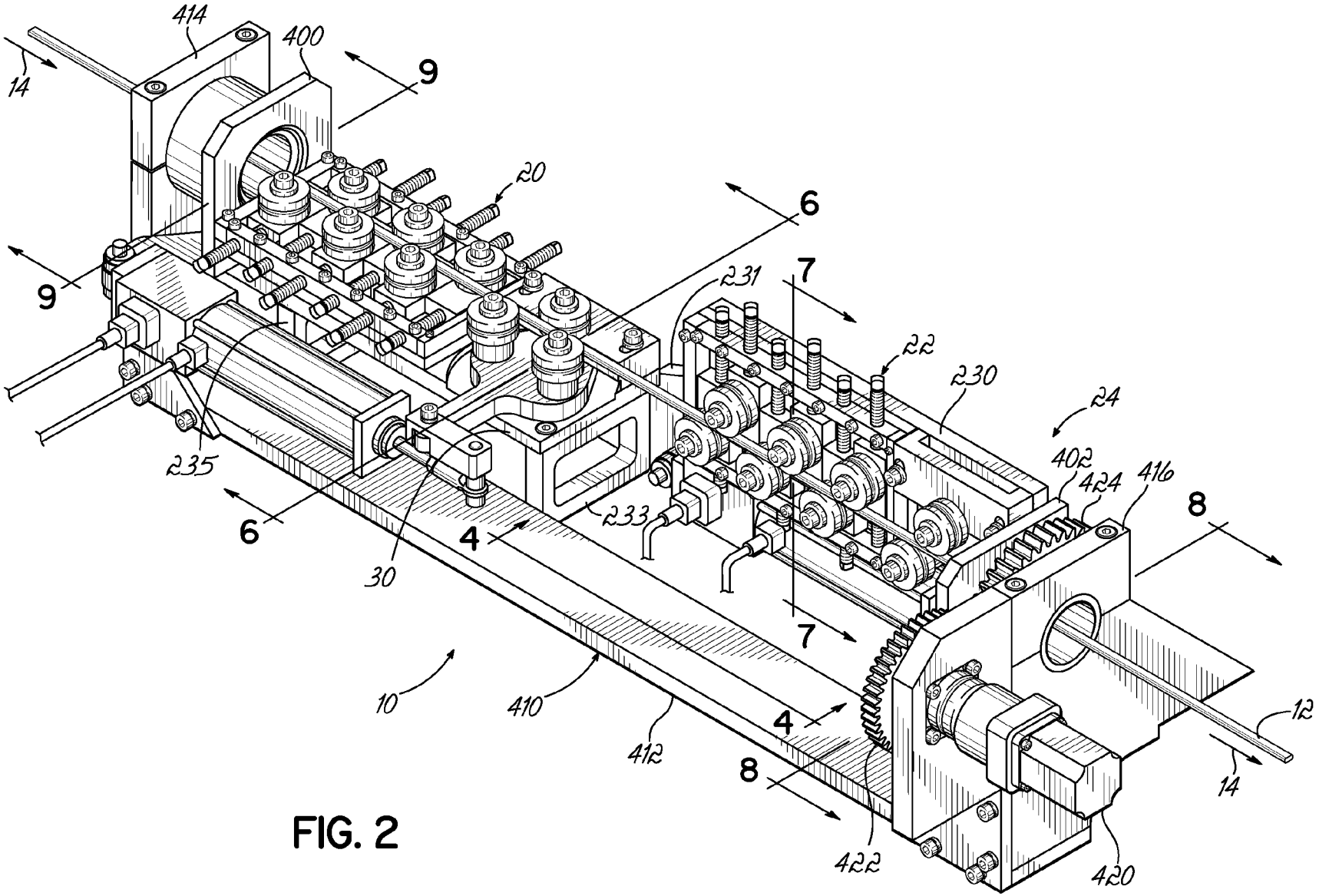
FIG. 2 is an enlarged perspective view of the straightener of FIG. 1.
Figure 3:
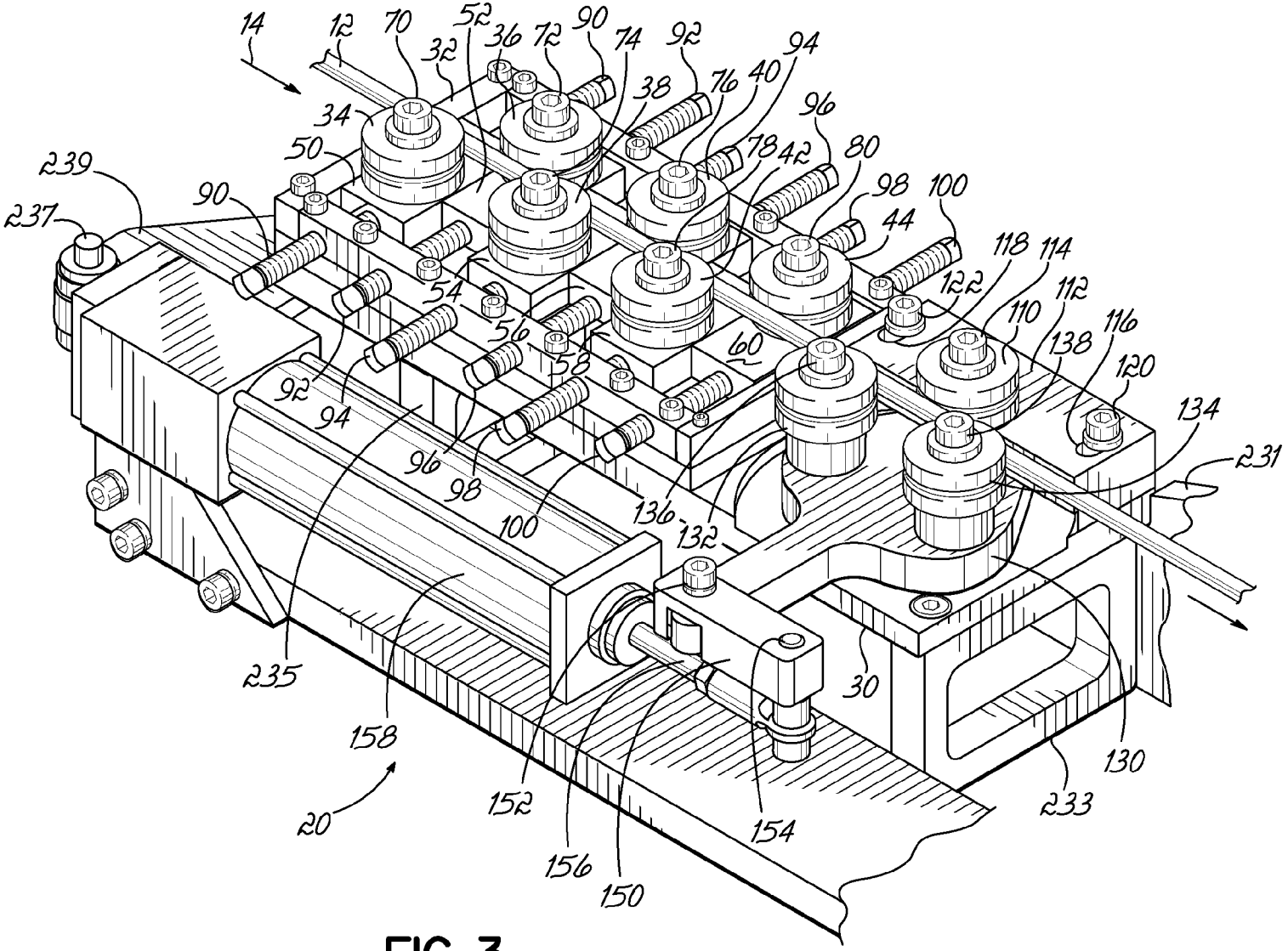
FIG. 3 is an enlarged perspective view of the horizontal wire straightener of the straightener of FIGS. 1 and 2.
Figure 4:
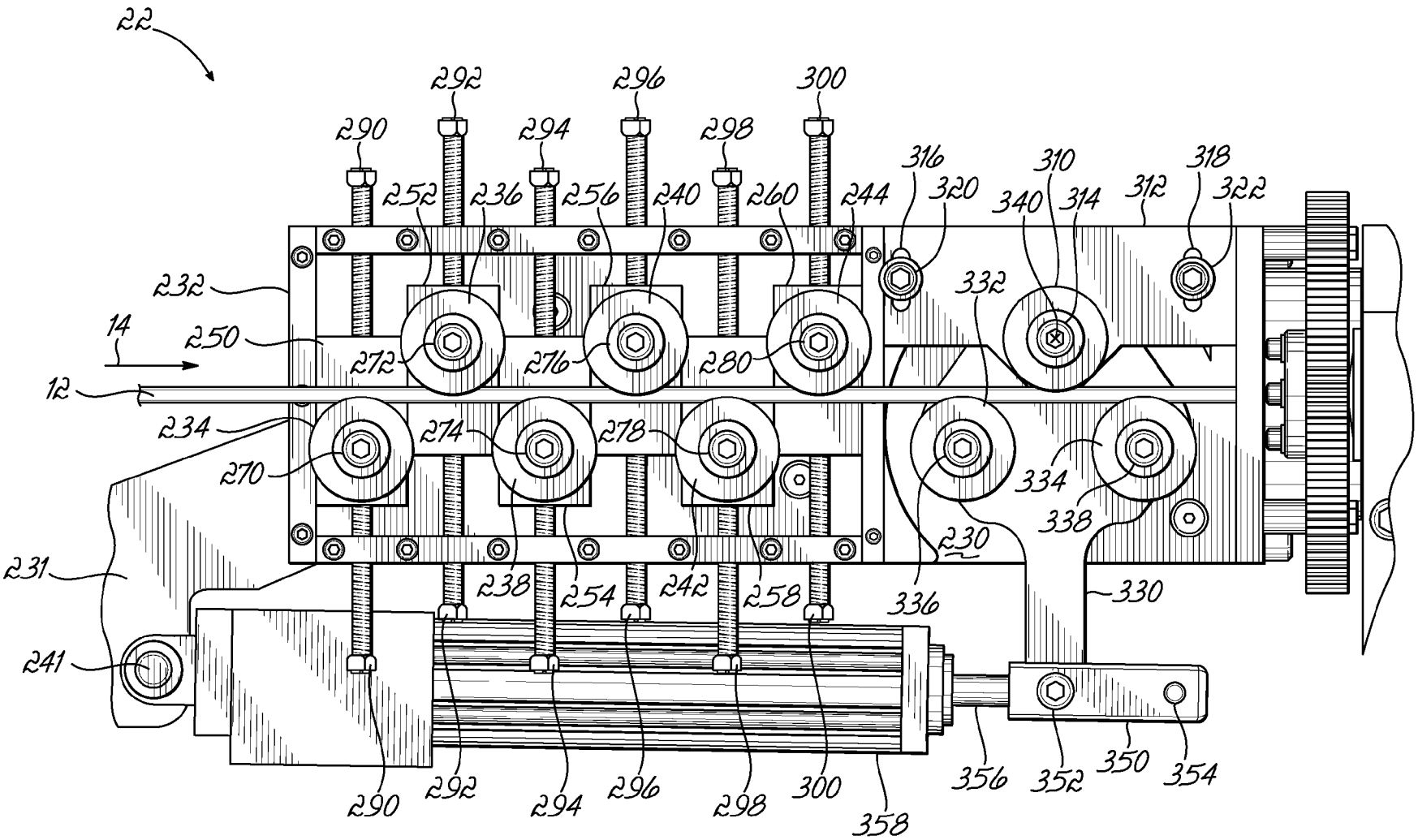
FIG. 4 is a view taken along line 4-4 in FIG. 2 showing the vertical wire straightener of the straightener of FIGS. 1 and 2.

Referring to FIGS. 1-3, horizontal straightener 20 comprises a horizontal base plate 30 to which is mounted a rectangular frame 32. Within frame 32 are moveably mounted a plurality of free-wheeling rollers, for example rollers 34, 36, 38, 40, 42, and 44. Rollers 34, 36, 38, 40, 42, and 44 are rotatably mounted to respective mounting blocks 50, 52, 54, 56, 58, 60 with respective screws 70, 72, 74, 76, 78, 80 and suitable bearings. Respective opposing pairs of adjustment screws 90, 92, 94, 96, 98, 100 allow the rollers 34, 38, 42 to be adjusted towards or away from rollers 36, 40, 44 within frame 32.

Figure 5A:
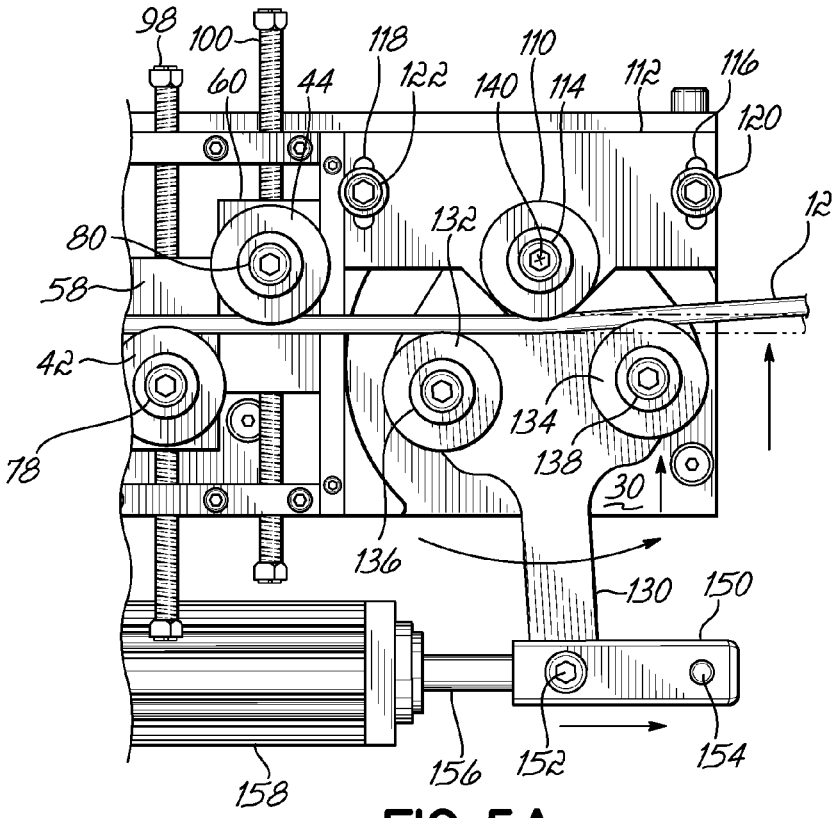
FIGS. 5A and 5B are enlarged top views of the pivot plate of the horizontal straightener of FIG. 3.
Figure 5B:
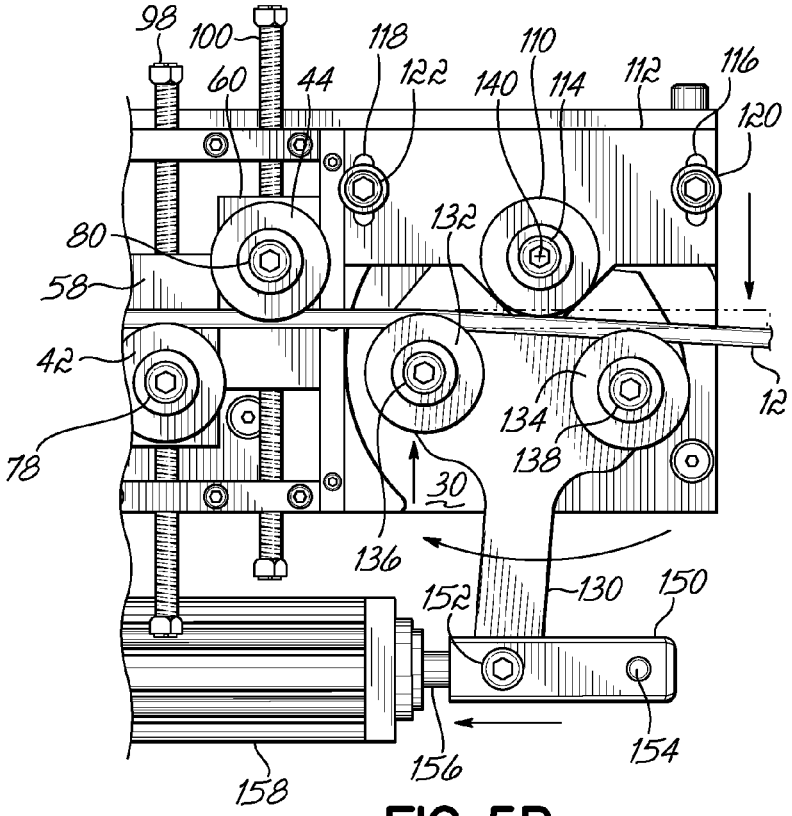

Horizontal straightener 20 further includes a free-wheeling roller 110 mounted to a block 112 with a screw 114 and suitable bearing. Block 112 includes slotted holes 116, 118 and screws 120, 122 mounting block 112 to horizontal base plate 30 that permit block 112 and hence roller 110 to be adjusted towards or away from the wire feed path. Horizontal straightener 20 further includes a pivot plate 130 having free-wheeling rollers 132, 134 rotatably mounted thereto with screws 136, 138, respectively and suitable bearings. Referring to FIGS. 5A and 5B, pivot plate 130 pivots on one end, and roller 110 rotates, about a common axis 140. The opposite end of pivot plate 130 is pivoted to a pivot arm 150 at one end of the pivot arm 150 with a screw 152. The other end of the pivot arm 150 is pivoted with a pin 154 to a linear actuator rod 156 which is actuated by a servo motor 158. Servo motor 158 is pivoted with a pin 237 to a bracket 239 mounted to horizontal base plate 30. Adjusting the position of the linear actuator rod 156 as shown in FIG. 5A causes the wire 12 to be bent in one direction within the horizontal plane, whereas adjusting the position of the linear actuator rod 156 as shown in FIG. 5B causes the wire 12 to be bent in the other direction within the horizontal plane.

Figure 6:
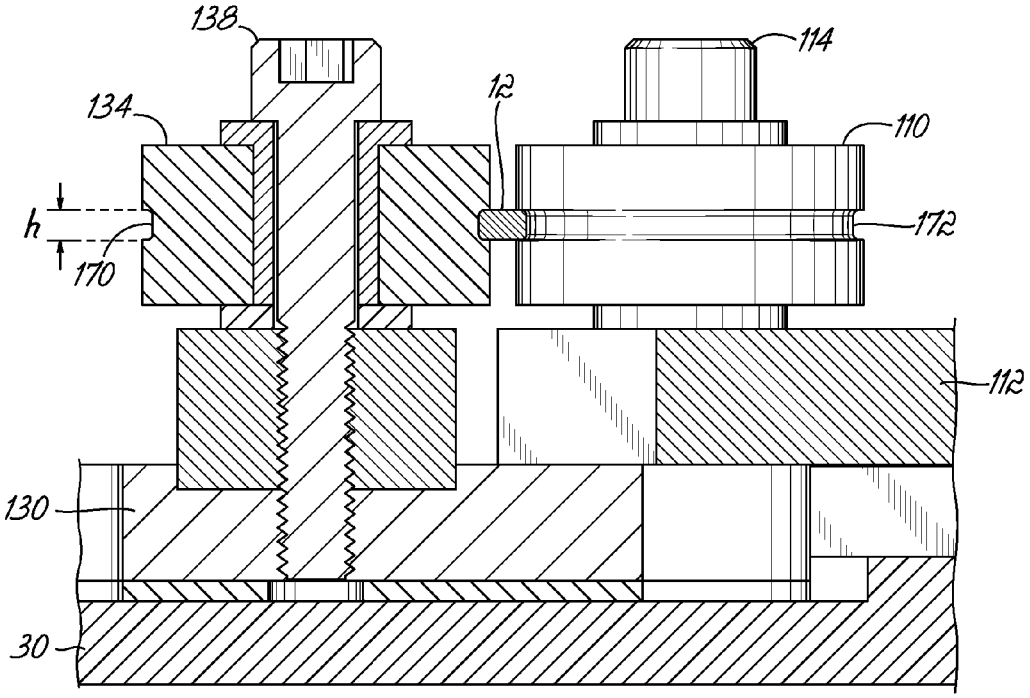
FIG. 6 is a cross-sectional view taken along line 6-6 in FIG. 2.

Referring to FIG. 6, it can be seen that the rollers of the horizontal straightener 20 include cooperating grooves for receiving the wire 12. For example, as illustrated, roller 134 includes groove 170 and roller 110 includes complimentary groove 172. The wire 12, illustrated as being rectangular in cross-section, has a width w and a height h (see FIG. 7 for width w). The grooves 170, 172 are sized to receive the wire 12 and to prevent the wire 12 from twisting relative to the grooves 170, 172. Note that w can be equal to h, in which case wire 12 would have a square cross-section.

Referring to FIGS. 1-4 and 10, vertical straightener 22 comprises a vertical base plate 230 connected to horizontal base plate 30 with a backbone plate 231. Brackets 233, 235 are attached to backbone plate 231 and to base plate 30, the brackets 233, 235 underlying base plate 30. A rectangular frame 232 is mounted to vertical base plate 230. Within frame 232 are moveably mounted a plurality of free-wheeling rollers, for example rollers 234, 236, 238, 240, 242, and 244. Rollers 234, 236, 238, 240, 242, and 244 are rotatably mounted to respective mounting blocks 250, 252, 254, 256, 258, 260 with respective screws 270, 272, 274, 276, 278, 280 and suitable bearings. Respective opposing pairs of adjustment screws 290, 292, 294, 296, 298, 300 allow the rollers 234, 238, 242 to be adjusted towards or away from rollers 236, 240, 244 within frame 232.

Vertical straightener 22 further includes a free-wheeling roller 310 mounted to a block 312 with a screw 314 and suitable bearing. Block 312 includes slotted holes 316, 318 and screws 320, 322 mounting block 312 to vertical base plate 230 that permit block 312 and hence roller 310 to be adjusted towards or away from the wire feed path. Vertical straightener 22 further includes a pivot plate 330 having free-wheeling rollers 332, 334 rotatably mounted thereto with screws 336, 338, respectively and suitable bearings. Like in the horizontal straightener 20 referred to above and shown in FIGS. 5A and 5B, pivot plate 330 of vertical straightener 22 pivots on one end, and roller 310 rotates, about a common axis 340. The opposite end of pivot plate 330 is pivoted to a pivot arm 350 at one end of the pivot arm 350 with a screw 352. The other end of the pivot arm 350 is pivoted with a pin 354 to a linear actuator rod 356 which is actuated by a servo motor 358. Servo motor 358 is pivoted with a pin 241 to backbone plate 231. Similar to the operation of the horizontal straightener 20 shown in FIGS. 5A and 5B, adjusting the position of the linear actuator rod 356 outwardly causes the wire 12 to be bent in one direction within the vertical plane, whereas adjusting the position of the linear actuator rod 356 inwardly causes the wire 12 to be bent in the other direction within the vertical plane.

Figure 7:
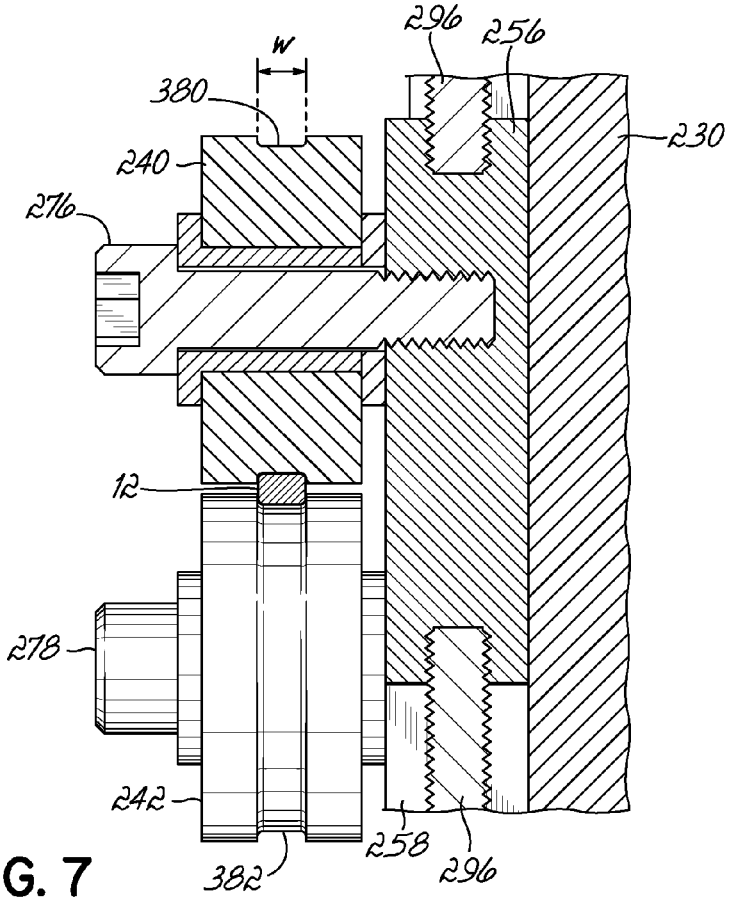
FIG. 7 is a cross-sectional view taken along line 7-7 in FIG. 2.

Referring to FIG. 7, it can be seen that the rollers of vertical straightener 22, like the rollers of the horizontal straightener 20, include cooperating grooves for receiving the wire 12. For example, as illustrated, roller 240 includes groove 380 and roller 242 includes complimentary groove 382. The wire 12, as mentioned before, is illustrated as being rectangular in cross-section, having a width w and a height h (refer back to FIG. 6 for height h). The grooves 380, 382 are sized to receive the wire 12 and to prevent the wire 12 from twisting relative to the grooves 380, 382.

Referring now to FIGS. 1, 2, 2A, 8, 9, and 10, carriage 24 comprises, generally, the horizontal base plate 30 and vertical base plate 230 interconnected by the backbone plate 231, and a first end plate 400 connected to horizontal base plate 30 and second end plate 402 connected to vertical base plate 230. Carriage 24 is rotatably supported in a carriage frame 410 comprising, generally, a carriage frame base plate 412, a first carriage frame end plate 414 and a second carriage frame end plate 416. A servo motor 420 is mounted to end plate 416 and drives a drive gear 422. Drive gear 422 drives a driven gear 424 nonrotatably mounted to end plate 402 of carriage 24.

Figure 8:
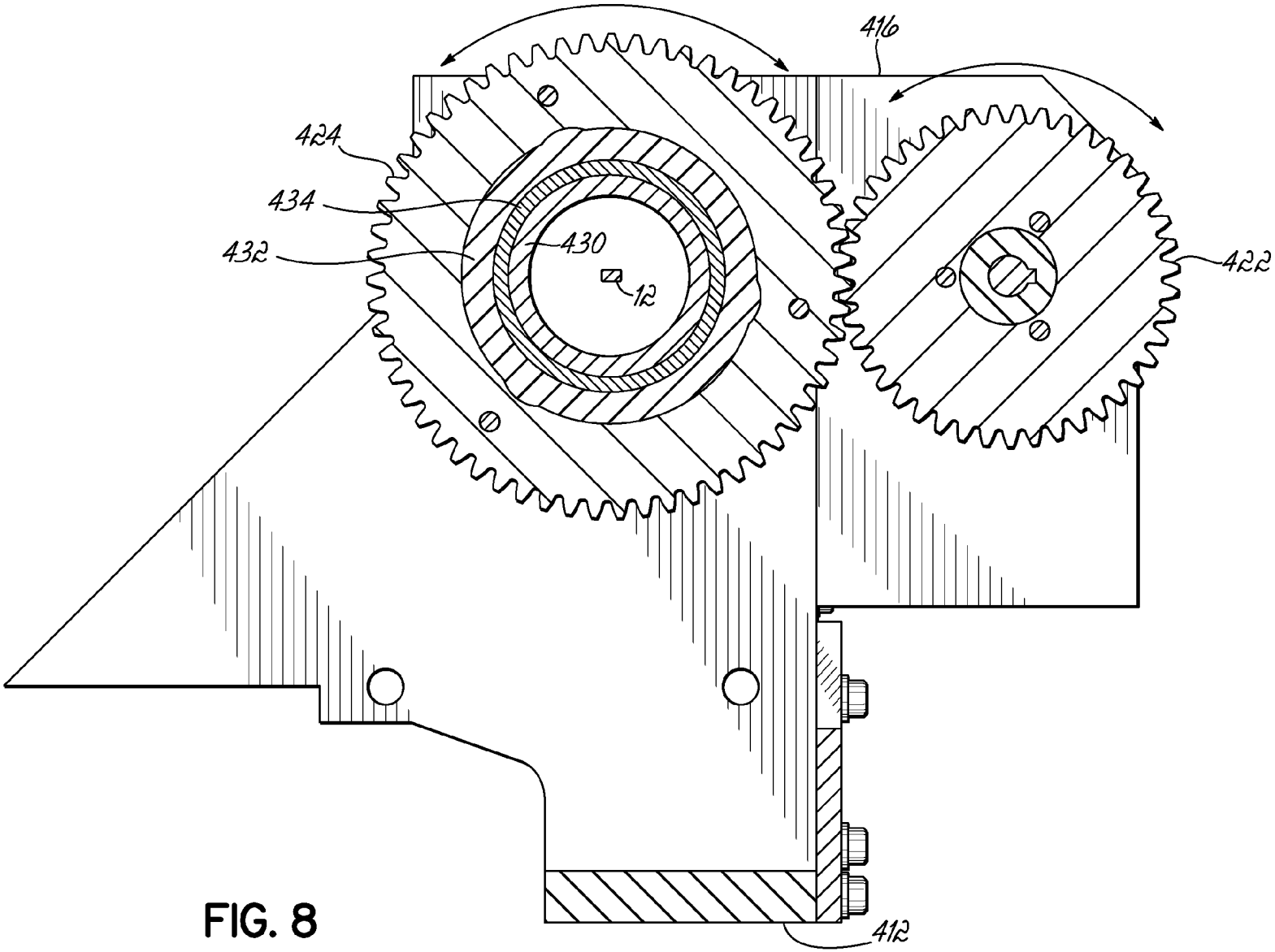
FIG. 8 is a cross-sectional view taken along line 8-8 in FIG. 2.

More particularly, and referring now to FIG. 8, a tube 430 is nonrotatably mounted to end plate 416 of carriage frame 410. A tube 432 is nonrotatably mounted to end plate 402 of carriage 24. A gear 424 is nonrotatably mounted on tube 432. Tube 432 is rotatably mounted on tube 430 with a bearing 434.

Figure 9:
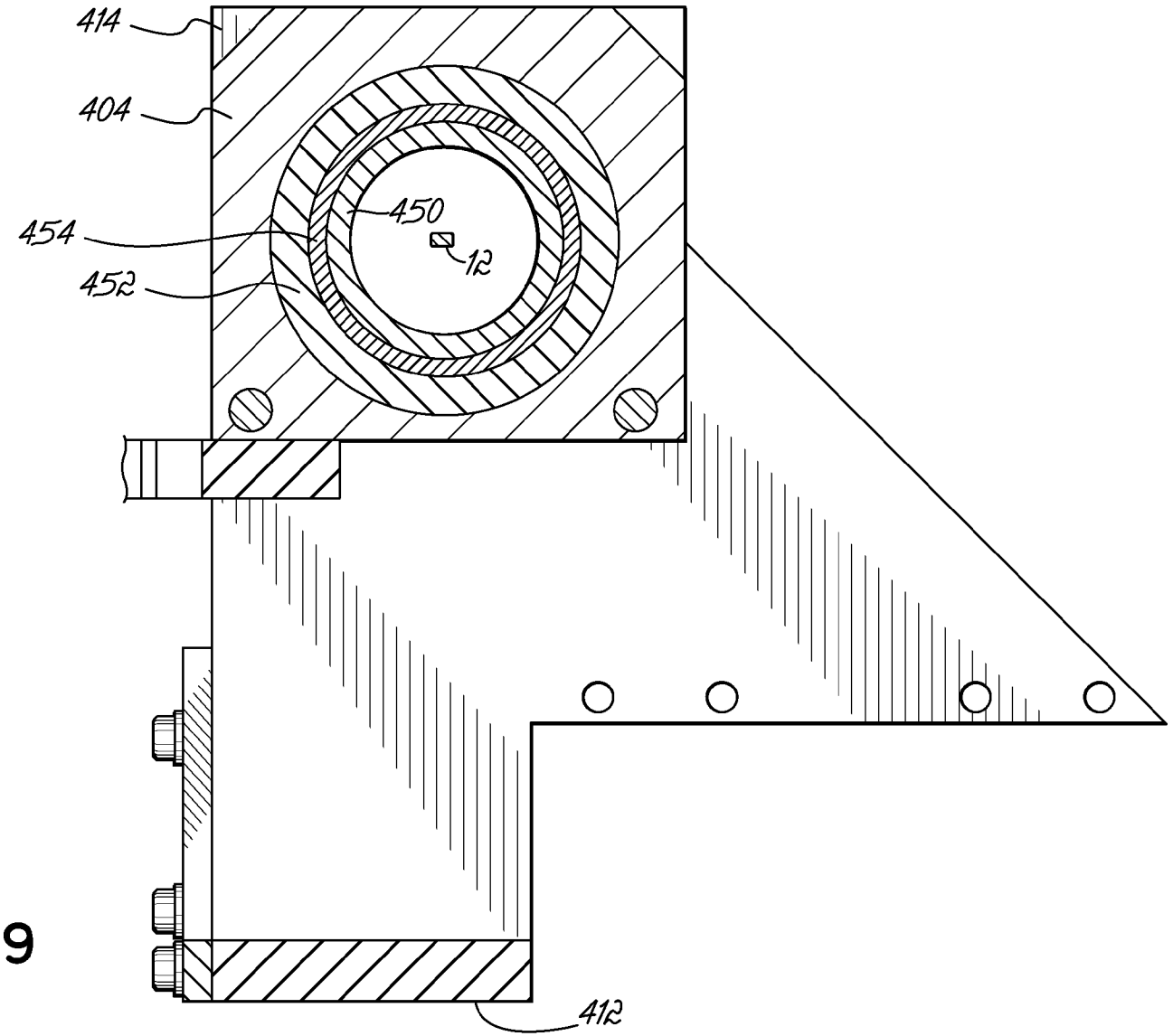
FIG. 9 is a cross-sectional view taken along line 9-9 is FIG. 2

Referring now to FIG. 9, a tube 450 is nonrotatably mounted to end plate 414 of carriage frame 410. A tube 452 is nonrotatably mounted to end plate 400 of carriage 24. Tube 452 is rotatably mounted on tube 450 with a bearing 454.

Figure 10:
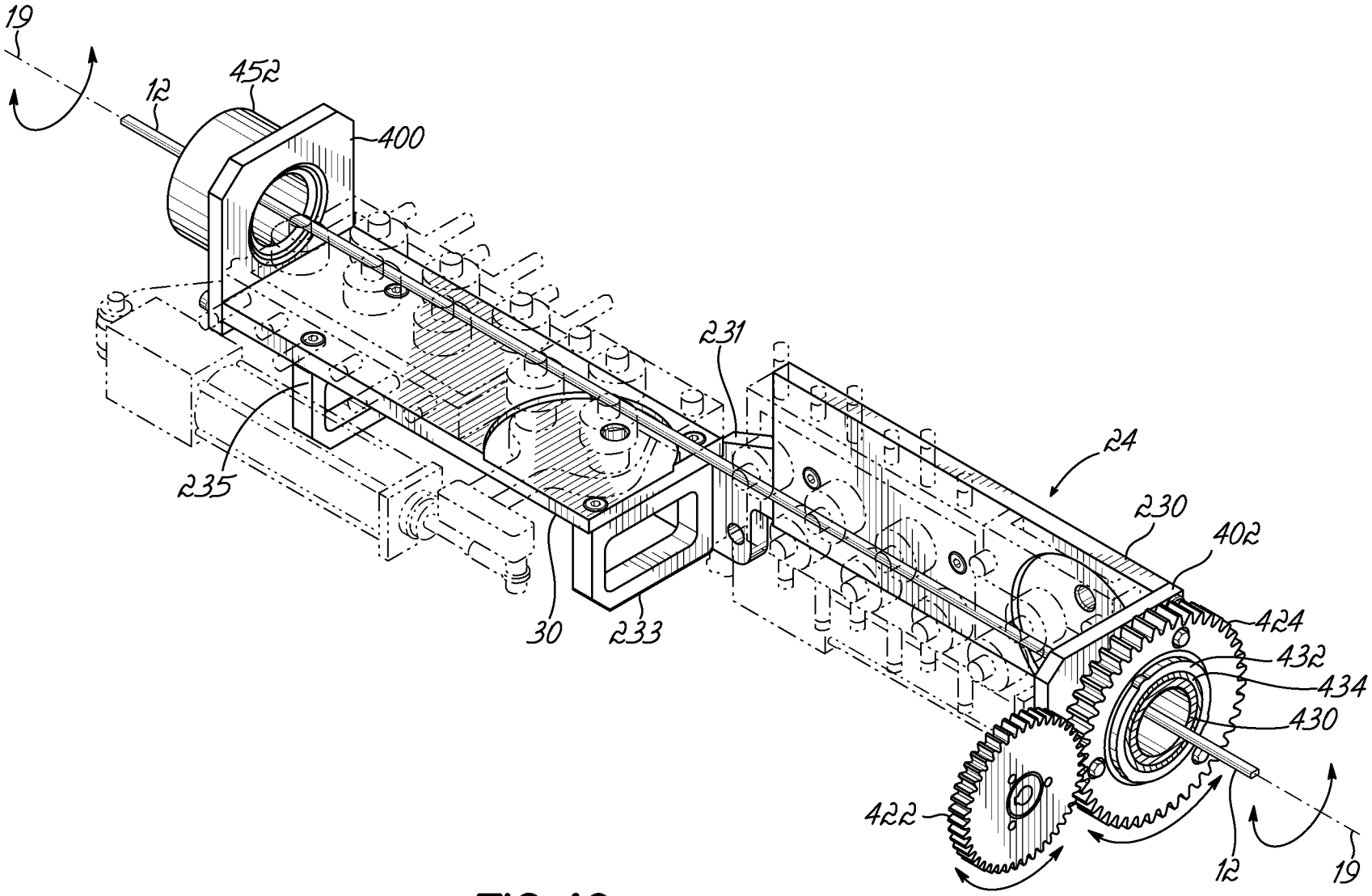
FIG. 10 is a diagrammatic front perspective view of the carriage of the straightener of FIGS. 1-9 rotating about an axis defined by the wire feed path.

Referring to FIG. 10, it can be seen that rotating gear 422 via motor 420 in a first direction, for example clockwise direction, results in gear 424 and hence carriage 24 being rotated in a counterclockwise direction, whereas rotating gear 422 via motor 420 in a counterclockwise direction results in gear 424 and hence carriage 24 being rotated in a clockwise direction.

Figure 11:
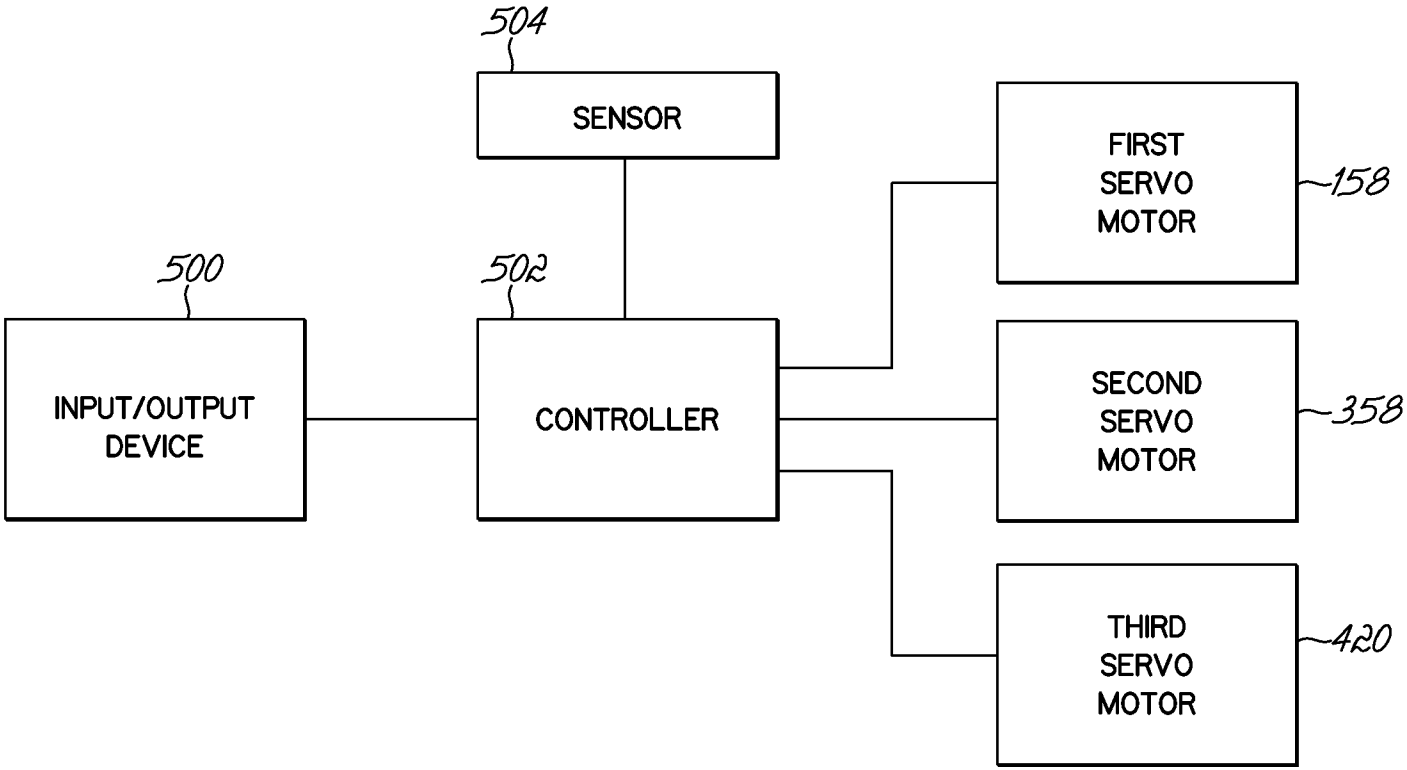
FIG. 11 is a block diagram of a control system for the straightener of FIGS. 1-10.

Referring now to FIG. 11, a block diagram of a control system for controlling the straightener 10 is illustrated. An input/output device 500, for example a mouse, a keyboard, a key-pad, a touch screen, a foot switch, etc., communicates with a controller 502, for example a commercially available processor such as a programmable logic controller (PLC), a general purpose processing chip with input and output ports and associated electronic data storage devices including read-only memory (ROM) and random-access memory (RAM), etc. The controller 502 communicates with the first servo motor 158, second servo motor 358, and third servo motor 420.

In use, an operator of the machine 10 visually monitors the curvature and twist of the wire 12 on the output side 18 of the wire feed box 16. Depending on the amount and direction of curvature of the wire 12 in the horizontal plane, the operator enters an appropriate input into the input/output device 500. The controller 502 receives the input and sends a corresponding output to the first servo motor 158, which moves the first linear actuator 156 in the appropriate direction and in the appropriate amount to straighten the horizontal curvature in the wire 12 observed by the operator. Depending on the amount and direction of curvature of the wire 12 in the vertical plane, the operator enters an appropriate input into the input/output device 500. The controller 502 receives the input and sends a corresponding output to the second servo motor 358, which moves the second linear actuator 356 in the appropriate direction and in the appropriate amount to straighten the vertical curvature in the wire 12 observed by the operator. Depending on the amount and direction of twist of the wire 12 about the axis 19 of the wire 12, the operator enters an appropriate input into the input/output device 500. The controller 502 receives the input and sends a corresponding output to the third servo motor 420, which rotates gear 422 to rotate gear 424 and carriage 24 in the appropriate direction and in the appropriate amount to untwist the twist in the wire 12 observed by the operator.

The embodiments shown and described are merely for illustrative purposes only. The drawings and the description are not intended to limit in any way the scope of the claims. Those skilled in the art will appreciate various changes, modifications, and other embodiments. For example, rather than the operator visually monitoring the curvature and twist of the wire 12 on the output side 18 of the wire feed box 16, a sensor 504 (FIG. 1), for example a machine vision sensor or the like, could be positioned on the output side 18 of the wire feed box 16 to monitor the curvature and twist of the wire 12. The sensor 504 would send inputs to the controller 502 (FIG. 11) based on the curvature and twist of the wire 12, and the controller 502 would in turn would send appropriate outputs to the servo motors to automatically straighten the wire. All such changes, modifications and embodiments are deemed to be embraced by the claims. Accordingly, the scope of the right to exclude shall be limited only by the following claims and their equivalents.

What is claimed is:

1. A wire straightener, comprising:
a wire feed path,
a first set of rollers disposed in a first plane along said wire feed path,
a second set of rollers disposed in a second plane along said wire feed path, said first and second planes being substantially perpendicular to one another,
a first motor operable to adjust a position of at least one of said rollers of said first set of rollers when actuated,
a second motor operable to adjust a position of at least one of said rollers of said second set of rollers when actuated, and
a third motor operable to rotate said first and second sets of rollers about an axis defined by said wire feed path.

2. The straightener of claim 1, wherein said first and second sets of rollers are mounted to a carriage, and said third motor is a servo motor operatively connected to said carriage through a gear assembly to rotate said carriage about the axis defined by said wire feed path.

3. The straightener of claim 1, wherein said first motor is a servo motor, said servo motor operatively connected to a first liner actuator operatively connected to at least one roller of said first set of rollers, such that adjusting a position of said first linear actuator adjusts a position of said at least one roller of said first set of rollers.

4. The straightener of claim 3, further comprising a first pivot plate operatively connected to said first linear actuator, and wherein said at least one roller of said first set of rollers comprises two rollers mounted to said first pivot plate, said first pivot plate configured to pivot and adjust a position of said two rollers of said first set of rollers based on movement of said first linear actuator.

5. The straightener of claim 4, wherein said first set of rollers comprises a third roller positioned on an opposite side of said wire feed path from said two rollers, said third roller having an axis of rotation, said first pivot plate having a pivot axis, said axis of rotation of said third roller and said pivot axis of said first pivot plate being collinear.

6. The straightener of claim 3, wherein said second motor is a servo motor, said servo motor operatively connected to a second liner actuator operatively connected to at least one roller of said second set of rollers, such that adjusting a position of said second linear actuator adjusts a position of said at least one roller of said second set of rollers.

7. The straightener of claim 6, further comprising a second pivot plate operatively connected to said second linear actuator, and wherein said at least one roller of said second set of rollers comprises two rollers mounted to said second pivot plate, said pivot plate configured to pivot and adjust a position of said two rollers of said second set of rollers based on movement of said second linear actuator.

8. The straightener of claim 7, wherein said second set of rollers comprises a third roller positioned on an opposite side of said wire feed path from said two rollers, said third roller having an axis of rotation, said second pivot plate having a pivot axis, said axis of rotation of said third roller and said pivot axis of said second pivot plate being collinear.

9. The straightener of claim 1, wherein said straightener is adapted to straighten a wire having a non-circular cross-section, and wherein said first and second sets of rollers include grooves adapted to receive the non-circular cross-section wire and prevent the wire from twisting relative to said grooves.

10. The straightener of claim 9, wherein the wire has a rectangular cross-section and said grooves are matingly rectangular.

11. A wire straightener, comprising:
a wire feed path,
a carriage rotatable about an axis defined by said wire feed path,
a first set of rollers mounted to said carriage and disposed in a first plane along said wire feed path,
a second set of rollers mounted to said carriage and disposed in a second plane along said wire feed path, said first and second planes being substantially perpendicular to one another,
a first motor operable to adjust a position of at least one of said rollers of said first set of rollers when actuated,
a second motor operable to adjust a position of at least one of said rollers of said second set of rollers when actuated, and
a third motor operable to rotate said carriage about the axis defined by said wire feed path.

12. The straightener of claim 11, wherein said first motor is a servo motor, said servo motor operatively connected to a first liner actuator operatively connected to at least one roller of said first set of rollers, such that adjusting a position of said first linear actuator adjusts a position of said at least one roller of said first set of rollers,
wherein said second motor is a servo motor, said servo motor operatively connected to a second liner actuator operatively connected to said at least one roller of said second set of rollers, such that adjusting a position of said second linear actuator adjusts a position of said at least one roller of said second set of rollers, and
wherein said third motor is a servo motor operatively connected to said carriage through a gear assembly to rotate said carriage about the axis defined by said wire feed path.

13. The straightener of claim 12, further comprising:
a first pivot plate operatively connected to said first linear actuator, and wherein said at least one roller of said first set of rollers comprises two rollers mounted to said first pivot plate, said first pivot plate configured to pivot and adjust a position of said two rollers of said first set of rollers based on movement of said first linear actuator, and
a second pivot plate operatively connected to said second linear actuator, and wherein said at least one roller of said second set of rollers comprises two rollers mounted to said second pivot plate, said pivot plate configured to pivot and adjust a position of said two rollers of said second set of rollers based on movement of said second linear actuator.

14. The straightener of claim 13, wherein said first set of rollers comprises a third roller positioned on an opposite side of said wire feed path from said two rollers, said third roller having an axis of rotation, said first pivot plate having a pivot axis, said axis of rotation of said third roller and said pivot axis of said first pivot plate being collinear, and wherein said second set of rollers comprises a third roller positioned on an opposite side of said wire feed path from said two rollers, said third roller having an axis of rotation, said second pivot plate having a pivot axis, said axis of rotation of said third roller and said pivot axis of said second pivot plate being collinear.

15. The straightener of claim 11 further comprising a controller in communication with said first, second, and third motors, said controller operable to receive inputs from a user and to send outputs to said first, second, and third motors representative of the inputs.

16. The straightener of claim 11, wherein said straightener is adapted to straighten a wire having a non-circular cross-section, and wherein said first and second sets of rollers include grooves adapted to receive the non-circular cross-section wire and prevent the wire from twisting relative to said grooves.

17. The straightener of claim 16, wherein the wire has a rectangular cross-section and said grooves are matingly rectangular.

18. A wire straightener, comprising:

a wire feed path, a first set of rollers disposed in a first plane along said wire feed path, a first motor operable to adjust a position of at least one of said rollers of said first set of rollers when actuated, and a controller in communication with said first motor, said controller operable to receive an input from a user indicative of a desired position of said at least one roller of said first set of rollers and to send an output to said first motor representative of the input to position said at least one roller of said first set of rollers in the desired position, a second set of rollers disposed in a second plane along said wire feed path, and a second motor operable to adjust a position of a least one of said rollers of said second set of rollers when actuated, said controller in communication with said second motor, said controller operable to receive an input from a user indicative of a desired position of said at least one roller of said second set of rollers and to send an output to said second motor representative of the input to position said at least one roller of said second set of rollers in the desired position and a third motor operable to rotate said first and second sets of rollers about an axis defined by said wire feed path.

19. The straightener of claim 18, wherein said first motor is a servo motor, said servo motor operatively connected to a first linear actuator, said first linear actuator operatively connected to at least one roller of said first set of rollers, such that adjusting a position of said first linear actuator adjusts a position of said at least one roller of said first set of rollers.

20. The straightener of claim 18, wherein said first and second planes are substantially perpendicular to one another.

21. The straightener of claim 18, wherein said second motor is a servo motor, said servo motor operatively connected to a second linear actuator, said second linear actuator operatively connected to at least one roller of said second set of rollers, such that adjusting a position of said second linear actuator adjusts a position of said at least one roller of said second set of rollers.

22. The straightener of claim 18, said controller being in communication with said third motor, said controller operable to receive an input from a user indicative of a desired position of said first and second sets of rollers and to send an output to said third motor representative of the input to position said first and second sets of rollers in the desired position.

23. The straightener of claim 18, wherein said third motor is a servo motor operatively connected to said first and second sets of rollers through a gear assembly to rotate said first and second sets of rollers about the axis defined by said wire feed path.

24. The straightener of claim 18, wherein said straightener is adapted to straighten a wire having a non-circular cross-section, and wherein said first and second sets of rollers include grooves adapted to receive the non-circular cross-section wire and prevent the wire from twisting relative to said grooves.

25. The straightener of claim 24, wherein the wire has a rectangular cross-section and said grooves are matingly rectangular.

26. A method of straightening a wire comprising the steps of:

feeding a length of wire from a supply of wire through first and second sets of rollers, straightening the length of wire in a first plane with the first set of rollers by moving a first roller of the first set of rollers relative to a second roller of the first set of rollers, straightening the length of wire in a second plane, substantially perpendicular to the first plane, with the second set of rollers by moving a first roller of the second set of rollers relative to a second roller of the second set of rollers, and untwisting the length of wire by rotating the first and second sets of rollers relative to the wire supply about an axis of the wire.

27. The method of claim 26 further comprising the step of controlling the movement of the first roller of the first set of rollers, the movement of the first roller of the second set of rollers, and the rotation of the first and second sets of rollers with a controller configured to receive inputs from a user indicative of desired positions of the first roller of the first set of rollers, the first roller of the second set of rollers, and the first and second sets of rollers, and to send outputs to respective first, second, and third motors representative of the inputs to position the first roller of the first set of rollers, the first roller of the second set of rollers, and the first and second sets of rollers in the desired positions.

28. A method of straightening a wire comprising the steps of:

feeding a length of wire from a supply of wire through first and second sets of rollers, monitoring a curvature and twist of the length of wire, and based upon the curvature and twist of the length of wire, straightening the length of wire in a first plane with the first set of rollers by moving a first roller of the first set of rollers relative to a second roller of the first set of rollers, straightening the length of wire in a second plane, substantially perpendicular to the first plane, with the second set of rollers by moving a first roller of the second set of rollers relative to a second roller of the second set of rollers, and untwisting the length of wire by rotating the first and second sets of rollers relative to the wire supply about an axis of the wire.

29. The method of claim 28 further comprising the step of controlling the movement of the first roller of the first set of rollers, the movement of the first roller of the second set of rollers, and the rotation of the first and second sets of rollers with a controller configured to receive inputs indicative of desired positions of the first roller of the first set of rollers, the first roller of the second set of rollers, and the first and second sets of rollers, based on the monitored curvature and twist of the wire, and to send outputs to respective first, second, and third motors representative of the inputs to position the first roller of the first set of rollers, the first roller of the second set of rollers, and the first and second sets of rollers in the desired positions.

30. The method of claim 29 wherein the step of monitoring the curvature and twist of the length of wire is performed visually by an operator.

31. The method of claim 29 wherein the step of monitoring the curvature and twist of the length of wire is performed by a sensor.

32. The method of claim 31 wherein the sensor is a machine vision sensor.

33. A wire straightener, comprising:

a wire feed path, a first set of rollers disposed in a first plane along said wire feed path, a second set of rollers disposed in a second plane along said wire feed path, said first and second planes being substantially perpendicular to one another, a first motor operable to adjust a position of at least one of said rollers of said first set of rollers when actuated, a second motor operable to adjust a position of at least one of said rollers of said second set of rollers when actuated, a third motor operable to rotate said first and second sets of rollers about an axis defined by said wire feed path, a sensor operable to detect a curvature and twist of a length of wire traveling along said wire feed path, and a controller in communication with said sensor and with said first, second, and third motors, said controller operable to actuate said first motor to adjust a position of said at least one roller of said first set of rollers, to actuate said second motor to adjust a position of said at least one roller of said second set of rollers, and to actuate said third motor to rotate said first and second sets of rollers about the axis defined by said wire feed path, in response to the curvature and twist detected by said sensor.

34. The straightener of claim 33 wherein said sensor is a machine vision sensor.

35. The straightener of claim 33, wherein said straightener is adapted to straighten a wire having a non-circular cross-section, and wherein said first and second sets of rollers include grooves adapted to receive the non-circular cross-section wire and prevent the wire from twisting relative to said grooves.

36. The straightener of claim 35, wherein the wire has a rectangular cross-section and said grooves are matingly rectangular.

* * * * *

UNITED STATES PATENT AND TRADEMARK OFFICE

CERTIFICATE OF CORRECTION

PATENT NO. : 8,763,436 B2
APPLICATION NO. : 13/179039
DATED : July 1, 2014
INVENTOR(S) : Kelly M. Knewtson It is certified that error appears in the above-identified patent and that said Letters Patent is hereby corrected as shown below:

In the Specification

Column 2

Line 33, "further comprising" should be ---further comprise---.

Column 4

Line 2, "FIG. 1 a perspective" should be ---FIG. 1 is a perspective---.

Figure 2A:
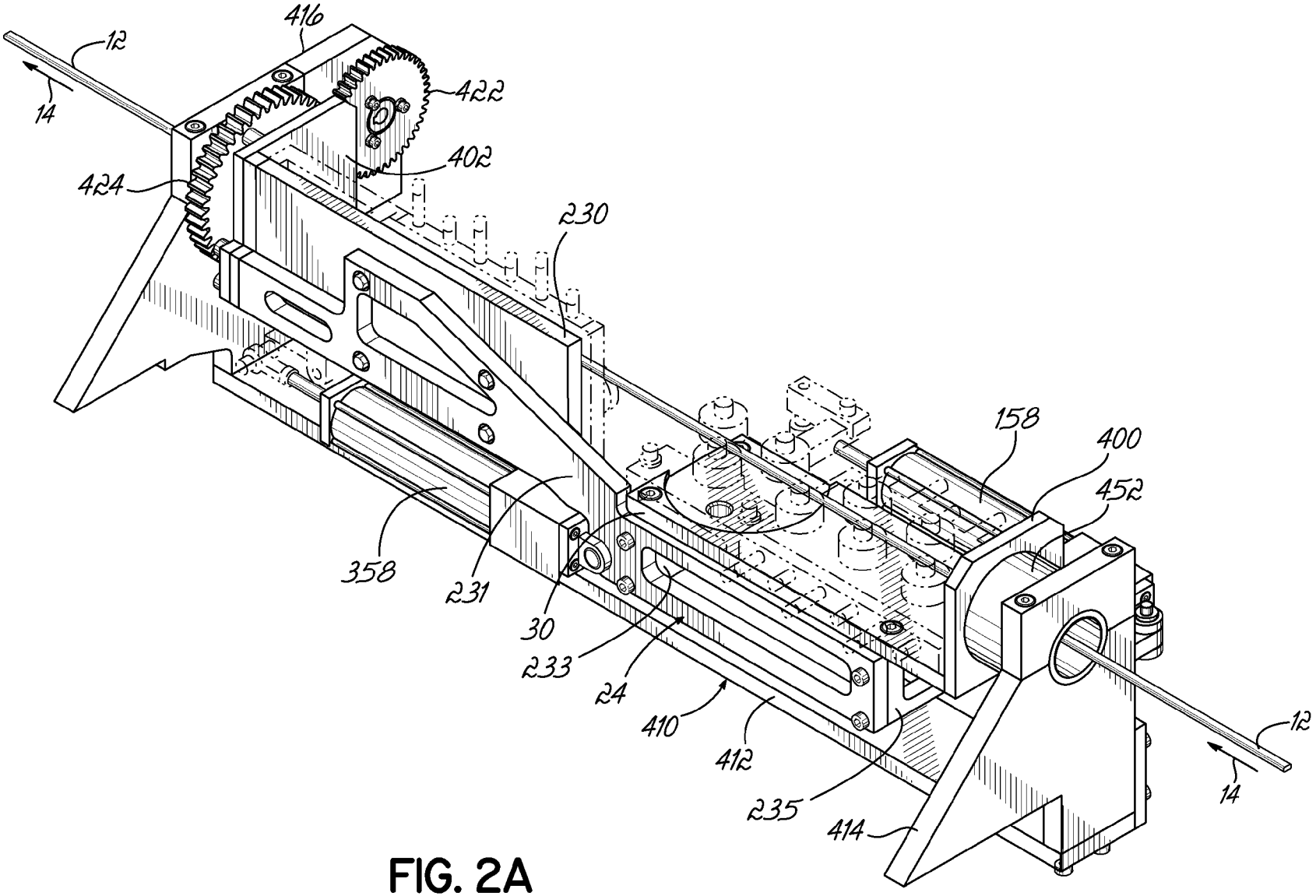
FIG. 2A is view similar to FIG. 2 but from the rear.

Line 6, "FIG. 2A is view" should be ---FIG. 2A is a view---.

Line 31, "principals" should be ---principles---.

Column 5

Line 19, "complimentary" should be ---complementary---.

Column 6

Line 2, "complimentary" should be ---complementary---.

In the Claims

Column 7

Line 47, "liner actuator" should be ---linear actuator---.

Line 66, "liner actuator" should be ---linear actuator---.

Column 8

Line 44, "liner actuator" should be ---linear actuator---.

Line 49, "liner actuator" should be ---linear actuator---.

Signed and Sealed this
Fourteenth Day of October, 2014

Michelle K. Lee

Michelle K. Lee
*Deputy Director of the United States Patent and Trademark Office*